US005673030A

United States Patent [19]

Kosich

[11] Patent Number: 5,673,030

[45] Date of Patent: Sep. 30, 1997

[54] ZERO INRUSH ALARM CIRCUIT

[75] Inventor: Joseph Kosich, South Toms River, N.J.

[73] Assignee: Wheellock, Inc., Long Branch, N.J.

[21] Appl. No.: 708,687

[22] Filed: Sep. 5, 1996

[51] Int. Cl.[6] ..... G08B 21/00

[52] U.S. Cl. ..... 340/635; 323/303; 323/901; 323/908; 328/278; 363/89

[58] Field of Search ..... 340/635; 363/89, 363/99, 53; 323/901, 902, 908, 321, 303, 300, 277, 278; 324/133; 361/18, 59, 96, 101; 219/485; 307/38, 40

[56] References Cited

U.S. PATENT DOCUMENTS 4,628,431 12/1986 Kayser ..... 323/901
4,719,553 1/1988 Hinckley ..... 363/89
4,952,906 8/1990 Buyak et al. ..... 340/331
5,010,293 4/1991 Ellersick ..... 328/278
5,087,871 2/1992 Losel ..... 323/303
5,121,033 6/1992 Kosich ..... 315/241
5,122,724 6/1992 Criss ..... 323/908
5,128,591 7/1992 Bocan ..... 315/241
5,374,887 12/1994 Drobnik ..... 323/908
5,400,009 3/1995 Kosich et al. ..... 340/331

*Primary Examiner*—Jeffrey Hofsass
*Assistant Examiner*—John Tweel, Jr.
*Attorney, Agent, or Firm*—Brumbaugh, Graves, Donohue & Raymond

[57] ABSTRACT

A zero inrush visual or visual/audible alarm circuit which includes a transistor switch and resistor combination connected in series with a storage capacitor provides inrush resistance for a period following initial power-on. The transistor switch may be controlled by a microcontroller or a simple timer.

15 Claims, 10 Drawing Sheets

ZERO INRUSH ALARM CIRCUIT

BACKGROUND OF THE INVENTION

This invention relates to circuits for electronic alarm systems such as are used to provide visual and audible warning in electronic fire alarm devices and other emergency warning devices and, more particularly, to an alarm unit circuit which prevents the problem of inrush.

Strobe lights and/or audio horns are used to provide warning of potential hazards or to draw attention to an event or activity. An important field of use for these signalling devices is in electronic fire alarm systems. Strobe alarm circuits typically include a flashtube and a trigger circuit for initiating firing of the flashtube, with energy for the flash typically supplied from a capacitor connected in shunt with the flashtube. In some known systems, the shunt capacitor is connected in series with an inductor as shown in FIG. 1. This circuit includes power supply terminals 2 and 4 across which is connected the supply voltage. Typically, the supply voltage may be 10.51–15.6 volts or 20–31 volts, and may be either D.C. or a full-wave rectified voltage. Underwriters Laboratories specifications require that operation of the device must continue when the supply voltage drops to as much as 80% of nominal value and also when it rises to 110% of nominal value. When the switch Q4 is closed, current from the power supply flows through, and thus stores energy in, the inductor L1. The switch Q4 is opened when sufficient energy is stored, and L1 discharges its energy causing current to flow through the diode D5, the resistor R5 and the charge capacitor C4. When the charge of C4 reaches a certain level, the flash unit 6 is fired and C4 is discharged by a current therethrough.

In this configuration, inrush may occur upon initial power-on. Inrush is a higher than average current which can materialize in the alarm unit when power is applied to the power terminals for the first time to begin alarm notification. The main cause of inrush is the large capacitor C4 used to store energy for the flash. Before an alarm condition, the voltages of the supply terminals are reversed so that the unit does not draw current. Thus, C4 is fully discharged. When an alarm condition occurs, the voltage polarity reverses and current begins to flow through diode D2 into the unit. Because L1 has very little resistance, C4 draws the higher inrush current in order to rapidly increase its charge. Inrush normally lasts 10 milliseconds or less after power is first applied to the terminals 2 and 4 until the capacitor C4 is charged up to the supply voltage.

Inrush can cause an overload in the power supply and panel. As a result, a fuse, if used, may break causing the system to cease functioning. If no fuse is used, the overload may damage relay contacts located in the panel which switch the system to an alarm condition.

In the prior art, inrush was limited to a tolerable level by adding a resistor R5 in series with and between the inductor L1 and the capacitor C4 and by selecting an appropriate value for R5. This solution has two problems. First, the inrush is not reduced below the average current as is optimal. In fact, inrush usually remains two to three times larger than the average current. Second, the resistor R5 reduces the efficiency of the alarm circuit during normal operation. Indeed, while a large resistance value is desirable when power is first applied to limit inrush, a smaller value is optimal, thereafter, for efficient operation of the circuit.

It is a primary object of the present invention to provide an alarm circuit which will limit inrush without reducing the efficiency of the circuit.

It is another object of the present invention to provide the ability to automatically adjust the inrush-limiting resistance so that its value changes between the power-on stage and the normal operation stage.

SUMMARY OF THE INVENTION

In accordance with the present invention, an alarm circuit is provided which is capable of producing a visual and/or audible alarm signal in an efficient manner while minimizing inrush. The alarm circuit includes a visual alarm producing circuit having a flashtube, a storage device, preferably an inductor, for storing energy supplied from a power source and another storage device, preferably a capacitor, connected in series to the inductor, for storing energy to be supplied to the flashtube. The alarm circuit also includes an inrush-limiting resistance connected in series with the capacitor, a first switch connected in series to the inductor such that, when the first switch is on, current flows through and energy is stored in the inductor and, when the first switch is off, energy is transferred from the inductor to the capacitor, and a second switch operatively coupled to the inrush-limiting resistance such that, when the second switch is off, current flows through the inrush-limiting resistance and, when the second switch is on, current flows through the second switch and does not flow through the inrush-limiting resistance. Finally, controlling devices are included to control the operation of the visual alarm producing circuit and the second switch so that the second switch is off for a time period sufficient to minimize inrush to the capacitor.

In a preferred embodiment of the invention, the alarm unit includes a diode and resistor connected in series between the inductor and the flashtube so that current does not flow through the flashtube after a flash has occurred. This embodiment prevents an afterglow effect in the flashtube.

Preferably, the alarm circuit also includes an audible alarm producing circuit that is controlled by the controlling device that controls the visual alarm producing circuit, that controlling device preferably being a microprocessor. In a preferred embodiment, the switch-controlling device also is a microprocessor or, alternatively, a timer.

The switches are preferably transistors. In a preferred embodiment, the alarm circuit includes an optocoupler which is connected to the first switch and the controlling device which controls the visual alarm producing circuit. The second switch is preferably connected in parallel with the inrush-limiting resistance and in series with the flashtube and capacitor parallel combination.

Preferably, the inrush-limiting resistance is a resistor. It is also preferable that the inrush-limiting resistance have two terminals and that the second transistor switch have a base terminal operatively coupled to the switch-controlling device, a collector terminal connected to a node between the capacitor and one terminal of the inrush-limiting resistance, and an emitter terminal connected to the other terminal of the inrush-limiting resistance.

A base resistor is preferably connected between the base terminal of the second transistor switch and the switch-controlling device so that current flowing from the switch-controlling device to the base terminal is limited.

It is preferable to set the time period within which the second switch is on to 100 milliseconds from the time power is first applied to the alarm unit.

The heightened inrush-limiting characteristics of this alarm unit due to the selective addition of the inrush-limiting resistance to the capacitor current path by means of a switch and controller prevents damage to the unit without sacrificing circuit efficiency.

BRIEF DESCRIPTION OF THE DRAWINGS

Other objects, features and advantages of the invention will become apparent, and its construction and operations better understood, from the following detailed description when read in conjunction with the accompanying drawings, in which.

DESCRIPTION OF THE PREFERRED EMBODIMENT

Figure 1:
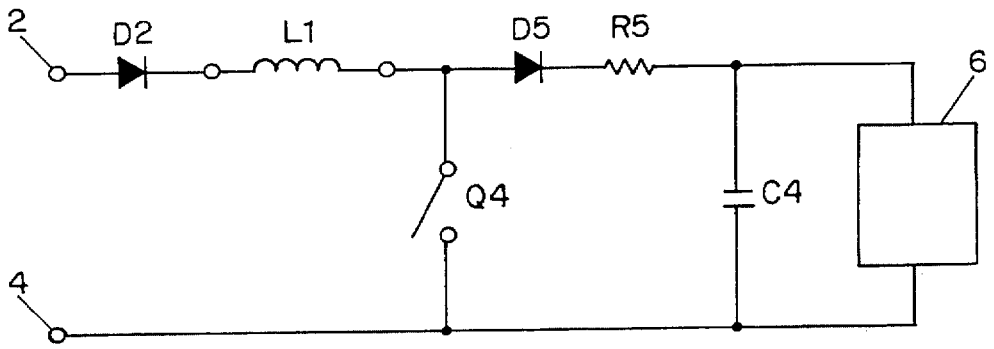
FIG. 1 (PRIOR ART)
FIG. 1 is a circuit diagram of a prior art alarm circuit.
Figure 2:
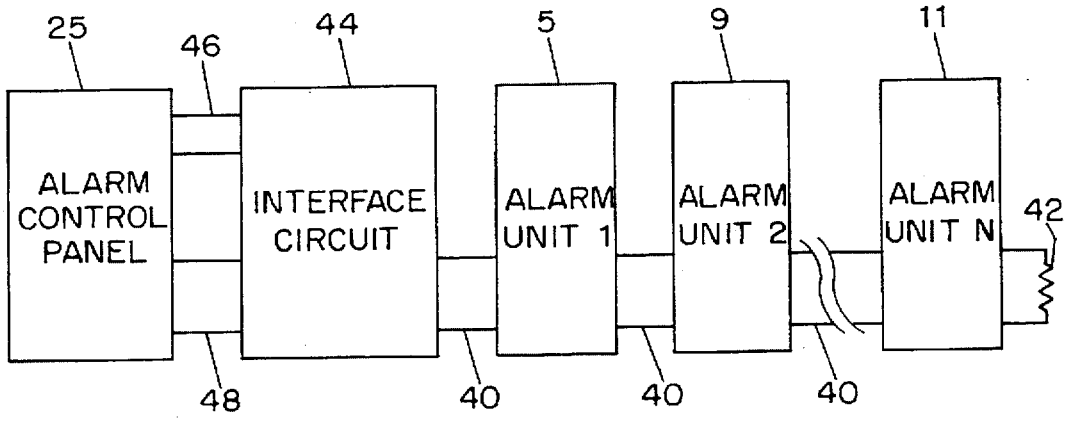
FIG. 2 is a block diagram of the alarm system employing alarm units of the present invention.

FIG. 2 is a block diagram of an embodiment of an alarm system in which the alarm circuit or unit of the present invention has particular utility. It will be understood, however, that the alarm circuit of the invention is not limited to such use, but may be used in other types of systems or circuits as well. In FIG. 2, multiple alarm units 5, 9 and 11, numbered 1 to N, are connected in a single control loop 40 with an end-of-line resistor 42. All units are caused to flash and sound synchronously using an interface control circuit 44 and the single control loop 40. The interface control circuit 44 is connected to the fire alarm control panel 25 via a primary input loop 46 and a secondary input loop 48. The alarm control panel 25 and the interface control circuit 44 can either be two separate devices or built into one unit.

The interface control circuit 44 provides the capability of silencing the audio alarms by outputting a signal to the alarm circuits 1 through N on the common loop 40 when a "silence" control signal is received from the fire alarm control panel 25 via the secondary input loop 48. According to this embodiment, a single power interruption or "drop out", of approximately 10 to 30 msec in duration, is used as the synchronization, or "sync", pulse to keep the alarm units in sync with one another. A "silence" control signal is communicated to each of the alarm circuits by a second "drop out" in very close proximity to the sync pulse. As will be discussed in greater detail hereinbelow, it is possible to use the "drop outs" to signal any one of a number of functions to the alarm units, "silence" being just one.

There are an infinite number of possible audio sounds and signalling schemes which may be employed in an alarm system. Actual or simulated bells, horns, chimes and slow whoops, as well as prerecorded voice messages, can all be used as audio alarm signals. One audio signalling scheme gaining popularity is the evacuation signal found in National Fire Protection Agency 72. The signal is also known as Code 3. A Code 3 signal consists of three half-second horn blasts separated by half-second intervals of silence followed by one and one-half seconds of silence. Some alarm systems currently in use are equipped with Code 3 capability. For such systems, the present invention may be implemented using the secondary input loop 48 to transmit a Code 3 signal from the existing fire alarm control panel 25 to the interface control circuit 44 which will, in turn, send out a Code 3 signal to the alarm units. If the fire alarm system is one which is not equipped with Code 3 capability, the interface control circuit 44 can provide the signal itself. For purposes of illustration, but not limitation, the Code 3 signal will be discussed hereinbelow as the signalling scheme of the present invention.

With regard to the visual alarm, for purposes of illustration, the strobe flashrate discussed herein is approximately 1.02 Hz under normal conditions. At an input voltage below the product specifications, the flashrate may be lowered to 0.5 Hz. Underwriters Laboratories permits a flashrate as low as 0.33 Hz.

Figure 3:
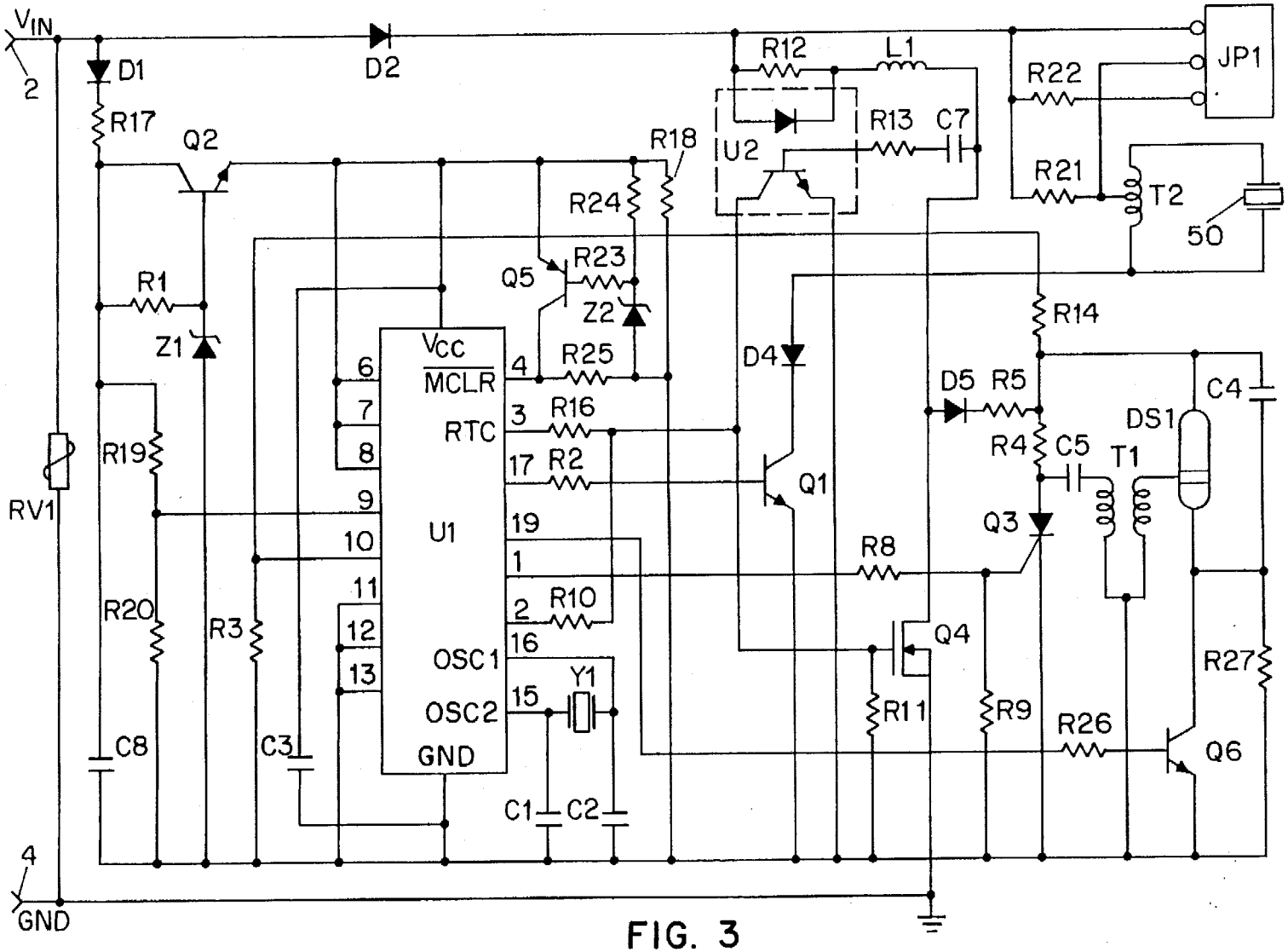
FIG. 3 is a circuit diagram of a preferred embodiment of the alarm unit of the present invention.

FIG. 3 is a circuit diagram of one embodiment of each of the alarm units 5, 9 and 11. The unit depicted is a microprocessor-controlled audible/visual alarm unit which serves to demonstrate the full range of features available in the present invention. One skilled in the art will appreciate that the invention is also applicable to an alarm unit having only visual, i.e. strobe, capabilities. The unit is energized by a D.C. power source connected to power terminals 2 (Vin) and 4 (GND). A metal oxide varistor RV1 is connected across the D.C. input to protect against transients on the input. A voltage regulator circuit provides the necessary voltage drop to power the microcontroller U1. Resistors R1 and R17 are connected in series between the cathode of a diode D1 and the base electrode of a switch Q2, and also to the cathode of a zener diode Z1 which provides a 5.60 volts ±5% reference. The collector of Q2 is connected to the common node of R1 and R17. Switch Q2 provides 5 volts to microcontroller U1 across terminals $V_{cc}$ and GND. A capacitor C3 connected across the $V_{cc}$ and GND terminals of U1 acts as a filter and will hold the voltage across U1 during the power drop outs which are used in the system as control signals.

A reset circuit for the microcontroller U1 includes a resistor R24 and a zener diode Z2 connected in series between the terminals Vcc and GND of microcontroller U1, a switch Q5 with its emitter electrode connected to the Vcc terminal, a resistor R25 connected between the collector electrode of the switch Q5 and GND, and a resistor R23 connected between the base electrode of the switch Q5 and the anode of the diode Z2. The junction between the switch Q5 and the resistor R25 is connected to the "MCLR" terminal 4 of the microcontroller U1.

Oscillations at a frequency of 4 MHz are applied to the terminals OSC1 and OSC2 of the microcontroller by a clock circuit consisting of a resonator Y1 and a pair of capacitors C1 and C2 connected between the ground and the first and second oscillator inputs, respectively.

Resistors R19 and R20 and a capacitor C8 provide a means at a microcontroller input terminal 9 for detecting gaps or drop outs in input power which indicate the presence of either a full wave rectified (FWR) input voltage or a sync or control pulse.

In the alarm circuit of FIG. 3, the flash circuit portion utilizes an opto-coupler U2 to control the D.C.-to-D.C. conversion of the input voltage to a voltage sufficient to fire the flashtube. In the opto-oscillator circuit, capacitor C4 connected in parallel with the flashtube DS1 is incrementally charged, through a diode D5 and a resistor R5, from an inductor L1, which is cyclically connected and disconnected across the D.C. supply. At the beginning of a connect/disconnect cycle, the light emitting diode (LED) and transistor of the optocoupler U2 are both off and the switch Q4 is on, completing a connection between the inductor L1 and the D.C. power source. As the current flow through L1 increases with time, the LED of U2 energizes and turns on the optically coupled transistor of U2 which in turn shuts off the switch Q4, thereby disconnecting L1 from the D.C. source. During the off period of the switch Q4, energy stored in the inductor L1 is transferred through a diode D5 and a resistor R5 to the series-connected capacitor C4. The capacitor C7 and the resistor R13 are connected in series between the diode D5 and the base of the transistor of the optocoupler U2. When the inductor L1 has discharged its stored energy into the capacitor C4, the LED of U2 ceases to emit light and the transistor of U2 turns off. This in turn causes Q4 to turn on, thereby beginning the connect/disconnect cycle again.

The on and off switching of Q4 and, therefore, the rate at which the increments of energy are transferred from the inductor L1 to the capacitor C4, is determined by the switching characteristics of the optocoupler U2, the values of the resistors R10, R11 and R12, the value of the inductor L1 and the voltage of the D.C. source, and may be designed to cycle at a frequency in the range from about 3000 Hz to 30,000 Hz. The repetitive opening and closing of the switch Q4 eventually charges the capacitor C4 to the point at which the voltage across it attains a threshold value required to fire the flashtube DS1. Overcharging of capacitor C4 is prevented by resistors R14 and R3 connected in series between the GND terminal 4 and the positive electrode of the capacitor C4. The values of these resistors are chosen to feed a portion of the voltage across the capacitor C4 back to the microcontroller U1. By checking for a relative high or low level after a trigger signal, the microcontroller U1 can determine if the flashtube DS1 fired. If the flashtube DS1 did not fire, the opto-oscillator circuit is shut down by way of opto-coupler U2 to prevent overcharging of the capacitor C4. This regulation of the capacitor's C4 voltage occurs in all modes of operation including D.C., FWR, Sync and non-Sync. The microcontroller implementation is less costly than a zener diode implementation and provides greater performance by eliminating zener tolerance issues.

In addition to the opto-oscillator circuit, the flash circuit includes a circuit for triggering the flashtube DS1. The trigger circuit includes a resistor R4 connected in series to the combination of a switch Q3, which in this embodiment is an SCR (or a TRIAC), connected in parallel with the series combination of a capacitor C5 and the primary winding of an autotransformer T1. The secondary winding of the autotransformer T1 is connected to the trigger band of the flashtube DS1. When the switch Q3 is turned on, the capacitor C5 pulses the primary winding of the transformer T1 and induces a high voltage in the secondary winding which, if the voltage on the capacitor C4 equals the threshold firing voltage of the flashtube, causes the flashtube DS1 to conduct and quickly discharge the capacitor C4. Q3 is turned on from a microcontroller output pin 1 and through a voltage divider composed of the resistors R8 and R9.

Optimally, the alarm unit depicted in FIG. 3 may also include an audio alarm circuit comprised, for example, of a resistor R2, a switch Q1, a diode D4, an autotransformer T2 and a piezoelectric element 50 connected as shown. The autotransformer T2 provides a voltage boost to the piezoelectric element 50 so that the audible alarm has more volume. The jumper selector JP1 is connected to the cathode of a diode D2, the autotransformer T2 and the resistors R21 and R22 to provide a means for adjusting the alarm volume. A "HIGH" volume setting connects T2 directly to D2. A "MEDIUM" volume setting connects T2 to D2 with the parallel combination of R21 and R22. Finally, the "LOW" volume setting connects D2 to T2 with R21. In the alarm unit shown, both the audible and visual alarm signals are controlled by the microcontroller U1, the audible signal being operated via an output terminal 17 and the visual signal being triggered via the output terminal 1. However, one skilled in the art will appreciate that a software timer means can be employed to cause the strobe to flash, e.g., in the event of a malfunction which causes a failure of the microcontroller U1 in the control unit 44 to send a sync signal.

In contrast to prior art implementations, the resistance of R5 may be reduced to a minimum value, e.g. 27 Ω, in the present invention. This value is sufficient to prevent the flashtube DS1 from exhibiting an afterglow effect due to current drawn from the power source after a flash occurs, but only minimally limits inrush. By using the smaller resistance R5, the operation of the circuit is made more efficient. In accordance with the invention, an inrush limiting resistance, e.g. resistor R27, is included in the circuit along with a switch Q6. The resistance of R27 is substantially larger than the resistance of R5, e.g. 390 Ω, so that its inrush-limiting capabilities are superior to those of the prior art. The resistor R27 and the switch Q6, to which the R27 is connected in parallel, are connected between the negative terminal of the capacitor C4 and the GND terminal 4. The resistor R26 is connected between the base electrode of the switch Q6 and the microcontroller pin 19 and serves to limit current from the pin 19 to the switch Q6.

In accordance with the invention, the switch Q6 is open for a period of time after power is applied to the power terminals 2 and 4. The period of time should be sufficient to minimize inrush, e.g., 100 milliseconds. After this period, the switch Q6 is turned on by the microcontroller U1 and remains on as long as power stays on. As a result, current ceases to flow through R27, leaving the minimal resistance R5 in the current path between L1 and terminal 4. In addition, at regular intervals, the software of the microcontroller U1 will refresh this function to be certain that the switch Q6 remains on thereafter. One skilled in the art would appreciate that the resistor R27 could be replaced with an equivalent resistance branch or network and the microcontroller could be replaced with a simple timer providing the desired off-period of the switch Q6.

By way of example, the circuit shown in FIG. 3, when using a 24 volt D.C. power source and producing a strobe with 15/75 candela brightness, may use the following parameters to obtain the above-described switching cycle:

| ELEMENT | VALUE OR NUMBER |
|---|---|
| C1, C2 | CAP., 33 pF, 50 V |
| C3 | CAP., 68 μF, 6.3 V |
| C4 | CAP., 47 μF, 250 V |
| C5 | CAP., .047 μF, 400 V |
| C7 | CAP., 33 pF, 250 V |
| C8 | CAP., .1 μF, 100 V |
| D1, D2 | DIODE 1N4004 |
| D4, D5 | DIODE HER106 |
| L1 | INDUCTOR, 5.05 mH |
| Q1 | TRANSISTOR, ZTX455 |
| Q2, Q6 | TRANSISTOR, 2N5550 |
| Q3 | SCR, EC103D |
| Q4 | TRANSISTOR, IRF710 |
| Q5 | TRANSISTOR, 2N2907 |
| R1 | RES., 4.7 KΩ, ¼W |
| R2 | RES., 560 Ω, ¼W |
| R4 | RES., 220 KΩ, ¼W |
| R5 | RES., 27 KΩ, ½W |
| R8, R10, R26 | RES., 1 KΩ, ¼W |
| R9, R16, R18, R23 | RES., 10 KΩ, ¼W |
| R11, R14 | RES., 1 MΩ, ¼W |

-continued

| ELEMENT | VALUE OR NUMBER |
|---|---|
| R12 | RES., 4.75 Ω, ¼W |
| R13 | RES., 100 KΩ, ¼W |
| R17 | RES., 330 Ω, ½W |
| R19 | RES., 10 KΩ, ¼W |
| R20 | RES., 2.21 KΩ, ¼W |
| R21 | RES., 680 Ω, ½W |
| R22 | RES., 270 Ω, ½W |
| R24 | 6.8 KΩ, ¼W |
| R25 | 39 KΩ, ¼W |
| R27 | 390 Ω, ½W |
| RV1 | VARISTOR, 68 V |
| T1, DS1 | FLASHTUBE/TRIGGER COIL ASS'Y |
| T2 | TRANSFORMER |
| U1 | MICROCONTROLLER, PIC16C54 |
| U2 | OPTOCOUPLER, 4N35 |
| Y1 | CERAMIC RES., 4 MHZ |
| Z1 | ZENER DIODE, IN4626 |
| Z2 | ZENER DIODE, IN4620 |

As mentioned hereinabove, the microcontroller U1 of the alarm unit is responsible for activating and deactivating the audio horn alarm in a desired sequence, detecting FWR or D.C. voltage and adapting the visual strobe alarm to a low input voltage by lowering the flashrate. The flowcharts of FIGS. 4, 4A–4G illustrate the software routines of the microcontroller of the alarm unit shown in FIG. 3.

Figure 4:
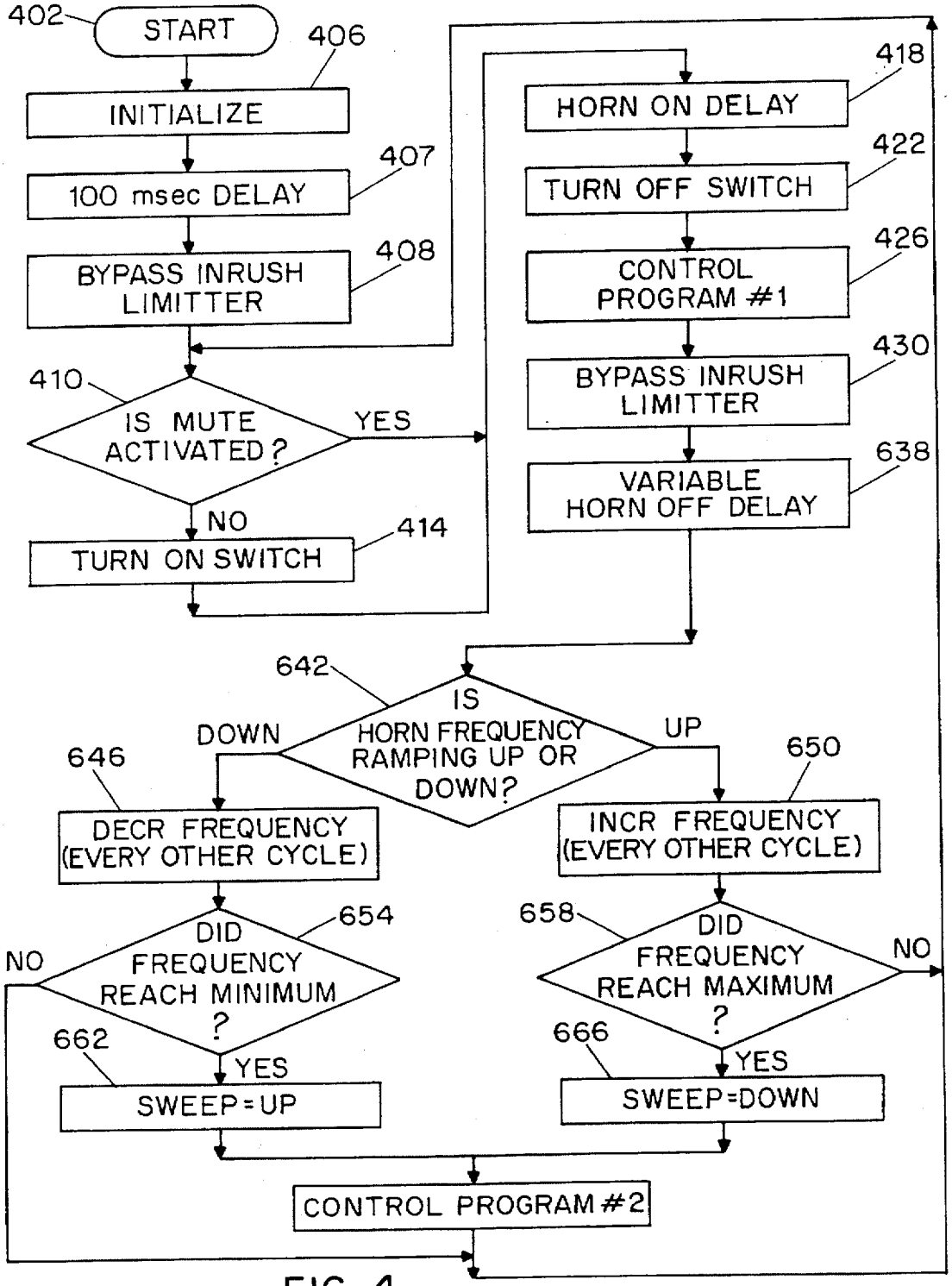
FIG. 4 illustrates the software routine of the main program of the microcontroller in the preferred embodiment.

FIG. 4 depicts the Main Program of the alarm unit microcontroller. This portion is responsible for the horn alarm and is executed at the desired center frequency for the horn, here approximately 3,500 Hz.

The program begins and is initialized at blocks 402 and 406. The program is delayed for, preferably, 100 milliseconds at block 407 during which time the switch Q6 is off and the resistors R5 and, particularly, R27 limit inrush. At block 408, the switch Q6 is turned on, thereby redirecting the current through Q6 and around the resistor R27. At block 410, an inquiry is made as to whether the horn is currently being muted, as will be the case if the Code 3 signal is in one of the half-second or one and one-half second silence periods or if the "SILENCE" feature has been activated. If the "MUTE" function is not activated, the microcontroller U1 will turn on the horn at block 414 by sending out a high signal from the microcontroller terminal 17 to turn on the switch Q1. The horn is programmed to have a varying frequency, here between 3,200 and 3,800 Hz, to better simulate an actual horn, and will ramp up and down between the set minimum and maximum frequencies. The "HORN ON DELAY" time, at block 418, is constant and may be chosen to be approximately 0.120 msec. The varying of the horn frequency is accomplished by ramping the "HORN OFF DELAY" time up and down. Following the "HORN ON DELAY", the horn is turned off at block 422 by turning off the switch Q1.

At block 426, Control Program No. 1 is run. Control Program No. 1 is responsible for detection and interpretation of the voltage dropouts, which serve as sync or control pulses (hereinafter "sync/control pulses") to the units, and is represented in flow-chart form in FIGS. 4A, 4B and 4C. These figures will be discussed in detail hereinbelow following the discussion of FIG. 4.

After leaving Control Program No. 1, the main program, at block 430, will turn on the switch Q6. At block 638, the program will begin the "HORN OFF DELAY". As mentioned above, the "HORN OFF DELAY" time will be varied to better simulate an actual horn sound. At block 642, the program will check to see whether the delay is currently being ramped up or down, and, in either of block 646 or 650, will continue the ramping in the current direction on every other Main Program cycle. At either block 654 or 658, the program will loop back to block 410 to determine if the "MUTE" function has been activated if neither the minimum nor maximum specified horn frequency has been reached, in this example 3,200 and 3,800 Hz, respectively. If the minimum or maximum frequency has been reached, the ramp direction will be changed at block 662 or 666, after which the program will run Control Program No. 2, depicted in FIGS. 4D, 4E, 4F and 4G.

Figure 4A:
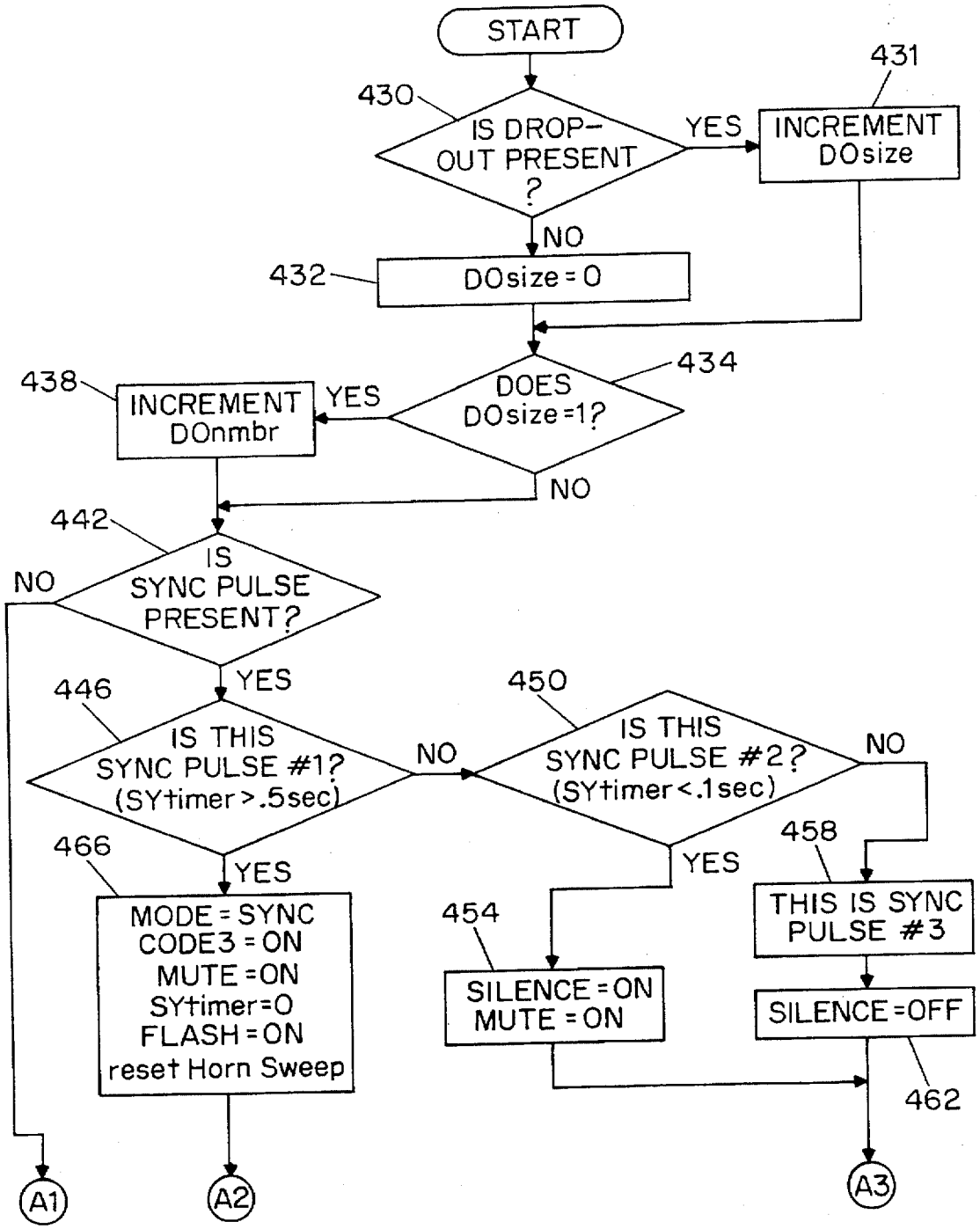
FIGS. 4A, 4B and 4C illustrate the software routine of Control Program No. 1.
Figure 4B:
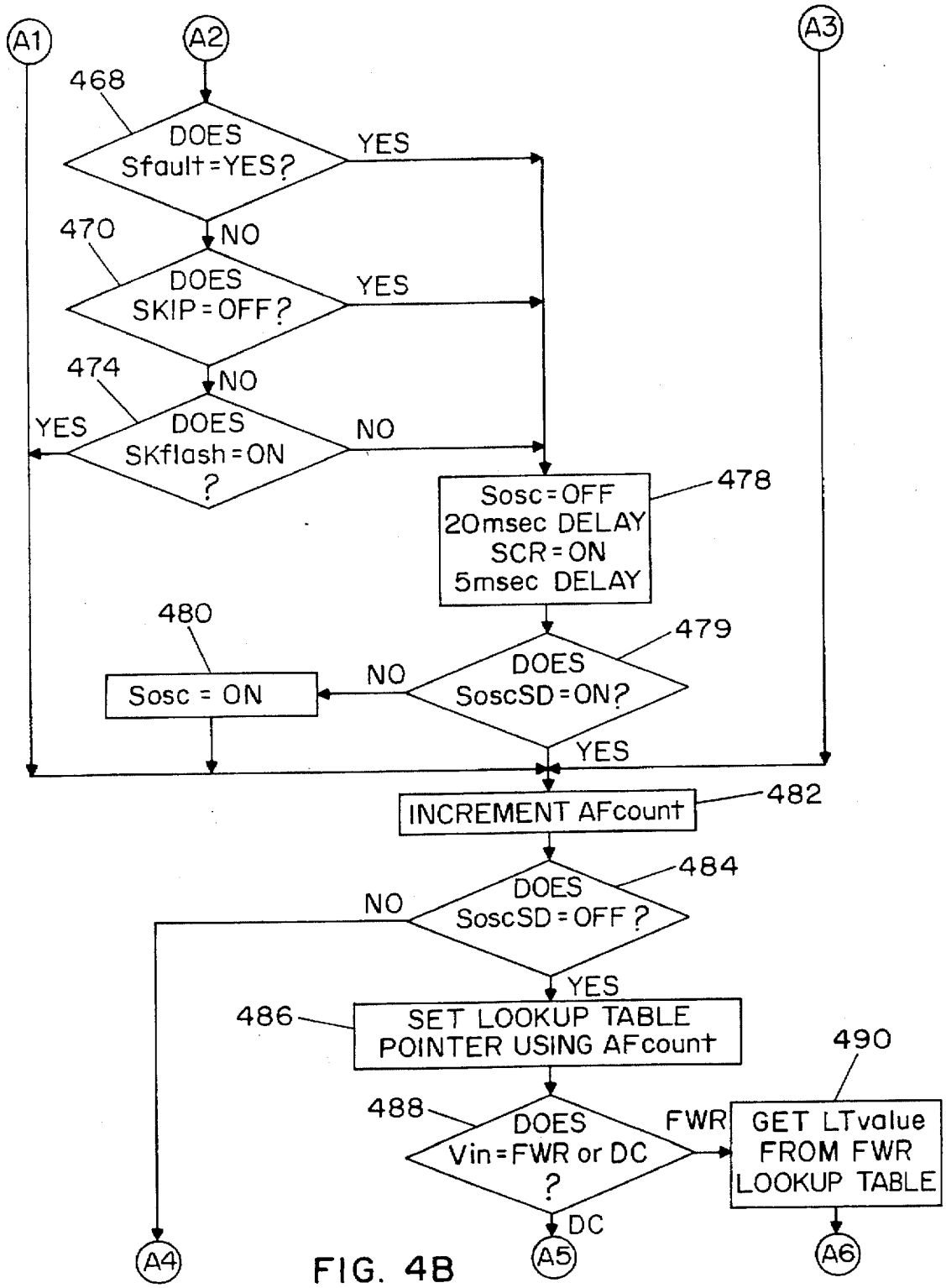
Figure 4C:
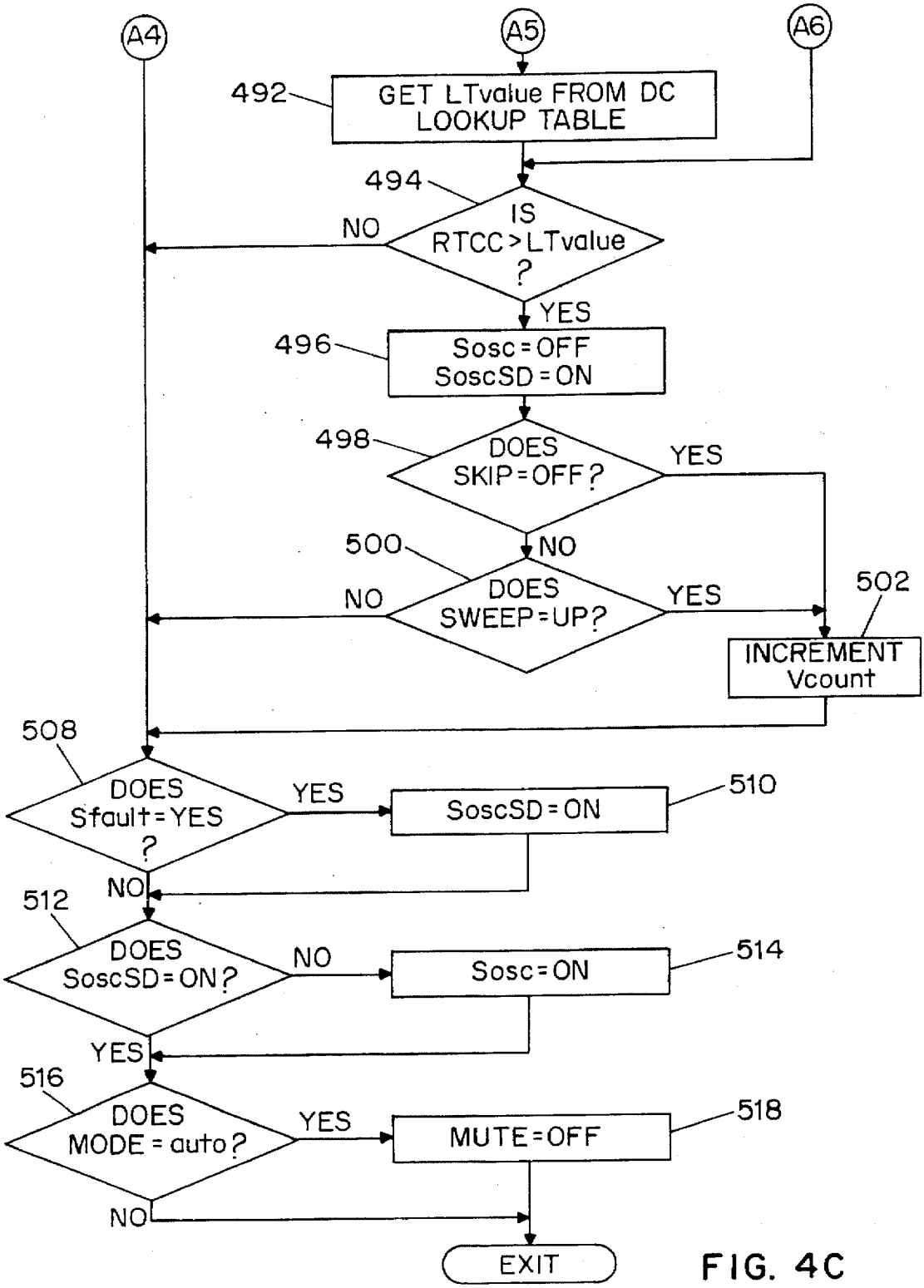
Figure 4D:
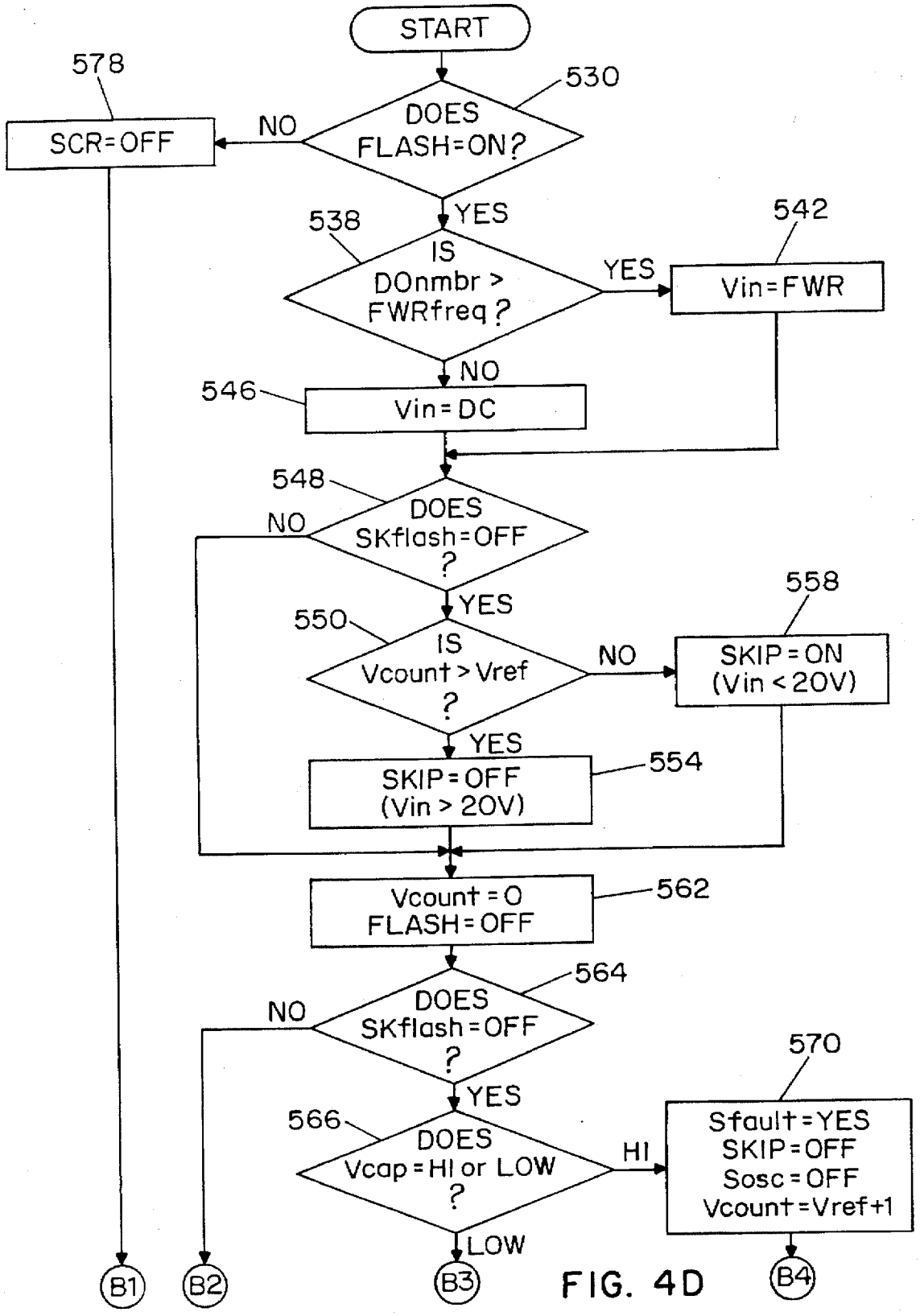
FIGS. 4D, 4E, 4F and 4G illustrate the software routine of Control Program No. 2.
Figure 4E:
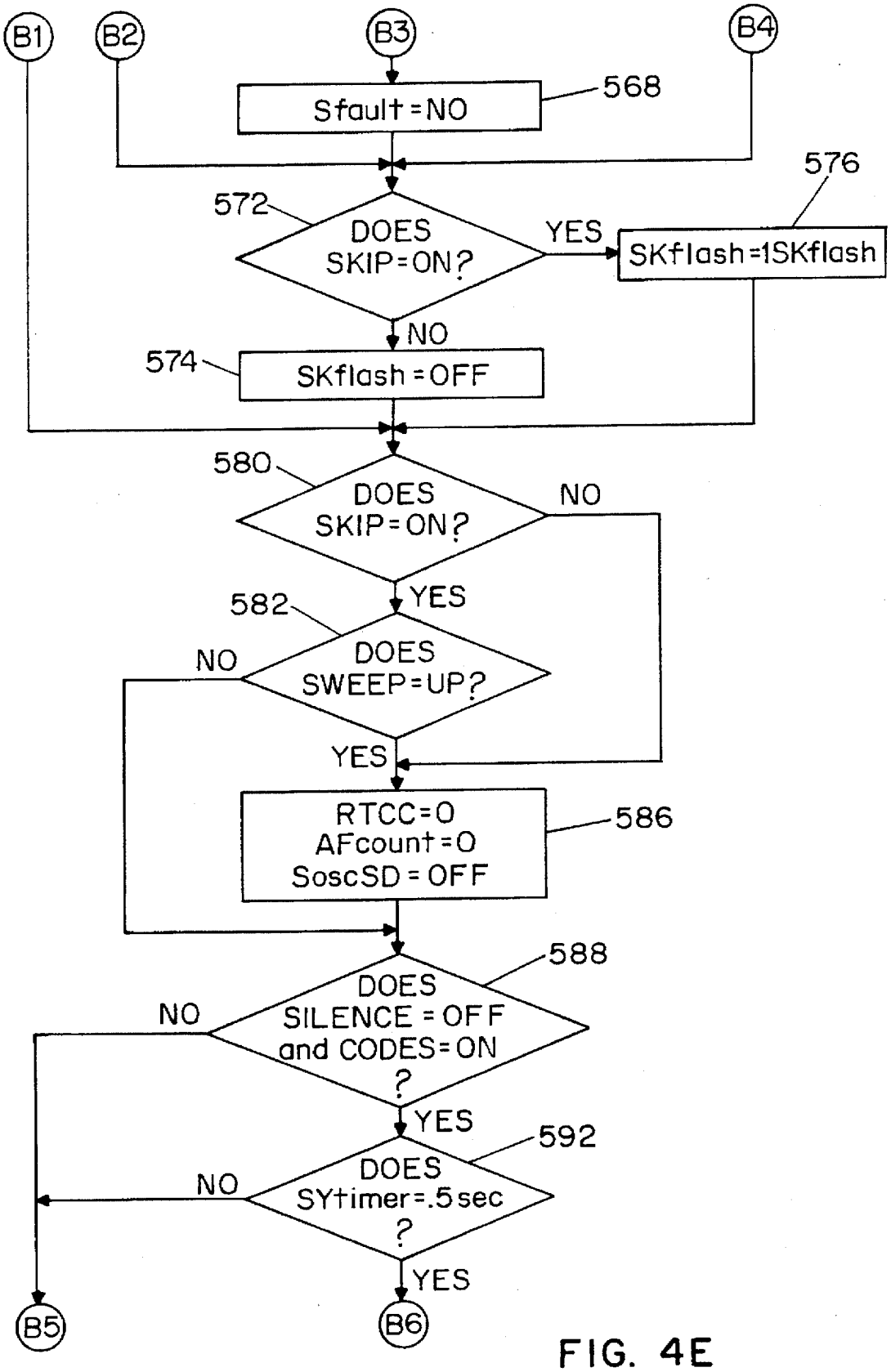
Figure 4F:
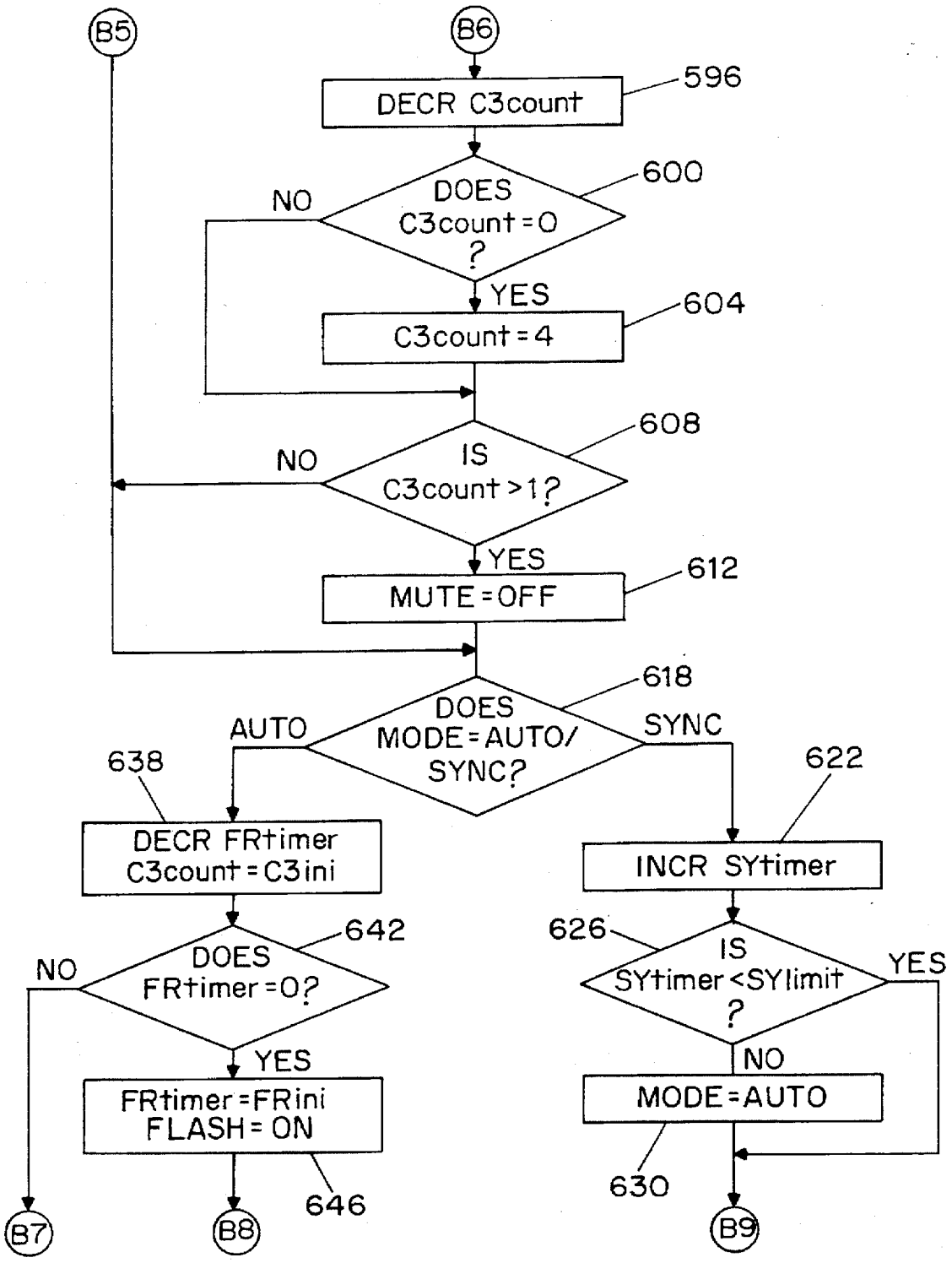
Figure 4G:
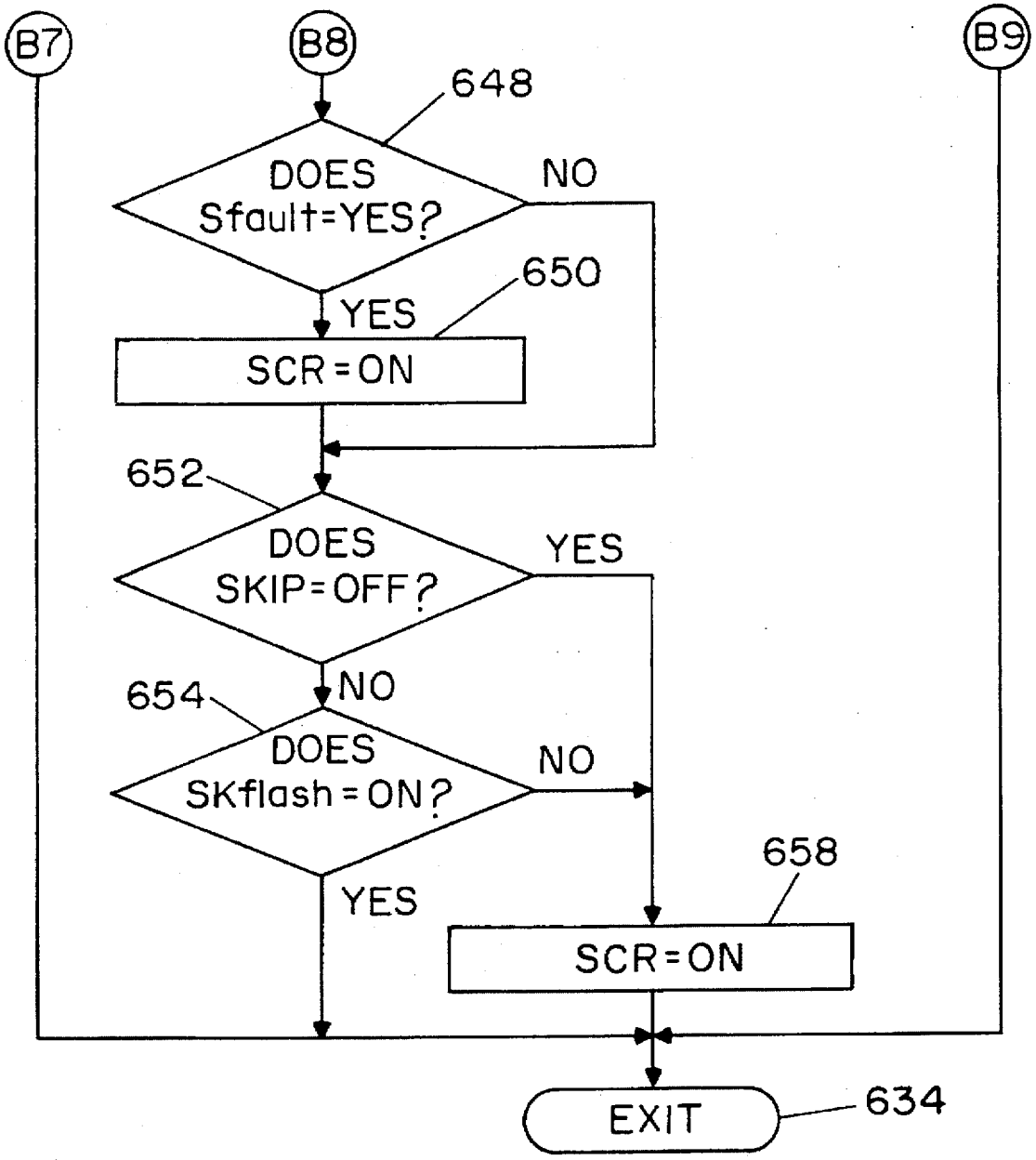

Turning now to FIGS. 4A, 4B and 4C, following the start of Control Program No. 1 the software looks for an input voltage drop out as indicated at block 430. Detection of a drop out indicates either a sync/control pulse or a FWR input voltage. Detection of the leading edge of a drop out initiates a counter "DOsize". If the drop out is present, "DOsize" is incremented at block 431. If no drop out is present, the counter is reset to zero at block 432. Drop outs are detected at the microcontroller input terminal 9.

Next, at block 434, the program checks to see if this is the beginning of a drop out by inquiring as to whether "DOsize=1." If so, the program at block 438 increments a counter, "DOnmbr", which keeps track of the number of dropouts. At block 442, the program checks for the presence of a sync/control pulse using the "DOsize" counter. If the drop out is wide enough, a sync/control pulse is present.

One skilled in the art will appreciate that multiple pulses can be used as control signals for the system. According to the present invention, in any such scheme, the first pulse will indicate the beginning of a new sync cycle. By way of example, here, the presence of a second pulse immediately following the first sync pulse will activate the "SILENCE" feature throughout the system and turn off any audio alarm which may be sounding. The presence of a pulse in the first and third pulse positions will deactivate the "SILENCE" feature causing the horns to sound when activated.

The software needed to perform these functions is illustrated in the flowchart of FIGS. 4A and 4B following block 442. If a sync/control pulse is detected, the program at block 446 determines whether it is a sync pulse by checking how much time has elapsed since the last pulse. If "SYtimer" indicates that it has been more than 0.5 seconds, then the pulse is the first of the cycle. If less than 0.1 seconds has elapsed, then the pulse is determined at block 450 to be in the second position and the "SILENCE" and "MUTE" features are activated at block 454. In this example, since only three pulse positions are being used, if "SYtimer" is any other value, then the pulse is determined at block 458 to be in the third position and the "SILENCE" feature is deactivated at block 462.

If the pulse is a sync pulse, block 466 sets several functions. "MODE" is set to "sync", "CODE 3" is turned on, "MUTE" is turned on, "SYtimer" is reset to zero, "FLASH" is turned on, and the horn frequency is returned to its starting position.

At block 468, the program checks to see if a strobe fault had occured ("Sfault"="YES"). If a fault did occur during the "sync" mode, the program jumps to block 478 and flashes the strobe by first delaying 20 msec, turning on the switch Q3 and then delaying another 5 msec. The control strobe oscillator "Sosc" is also turned off. If, however, a strobe fault did not occur, the program continues with block 470.

At block 470, the program checks to see if the "SKIP" function is off. The "SKIP" function and "SKflash" variable are used to cut the flashrate in half when the input voltage falls below an acceptable level, in this example 20 V. When the "SKIP" function is activated, the variable "SKflash" will toggle between on and off once each flash cycle causing every other flash to be skipped. This is seen in the flowchart at block 474 where if "SKIP" is not off, the program checks to see whether "SKflash" is on, which it will be every other cycle. On the other hand, if "SKIP" is off at block 470, the program jumps to block 478. If "SKpulse" is on at block 474, block 478 will be skipped and the strobe will not be flashed.

In block 479 and 480, the strobe oscillator is restarted if "SoscSD" is not on.

The next section of the program, beginning at block 482 in FIG. 4B, checks to see whether the capacitor C4 has been charged high enough to sufficiently flash the flashtube DS1. At block 482, a variable "AFcount" is incremented. "AFcount" is used to count the number of cycles of Control Program No. 1 which corresponds to the audio frequency of the audio alarm signal.

At block 484, inquiry is made as to the status of a control variable "SoscSD", which is indicative of the "oscillator shut down" function. "SoscSD" being on indicates that the opto-oscillator circuit should be shut down. If "SoscSD" is off, the program continues with box 486 which sets a lookup table pointer based on "AFcount", i.e., based upon how many audio signal cycles have elapsed. The lookup table value, "LTvalue", is a predetermined minimum desirable number of cycle counts for the opto-oscillator circuit and is used to determine whether the capacitor C4, which provides the energy to flash flashtube DS1, is charging too quickly. First, however, at block 488, the program determines whether Vin is FWR or D.C. Depending on which one it is, the program will determine "LTvalue" using either a FWR lookup table at block 490 or a D.C. lookup table at block 492.

Next, at block 494, "LTvalue" is compared to the number of connect/disconnect cycles of the opto-oscillator circuit responsible for charging C4. This is done by using the real time clock counter at the microcontroller input pin RTCC and the resistor R16 to keep count of the number of times the opto-oscillator circuit has cycled. If the count is greater than "LTvalue", then the oscillator circuit is turned off at block 496 by turning on "SoscSD" and turning off "Sosc".

At block 502, a variable "Vcount" is incremented. "Vcount" is used to determine whether the alarm unit is receiving a proper input voltage. Its significance will be discussed in greater detail hereinbelow.

Returning briefly to block 484, if "SoscSD" is not off, that is, if the "oscillator shut down" function is on, then the program jumps to block 508 and will not increment "Vcount". As will be seen hereinbelow, once "SoscSD" is turned on, it will not be turned off again until the Control Program No. 2 is executed. As discussed above with respect to the Alarm Unit Main Program, Control Program No. 2 is executed only at the top and bottom of the horn sweep cycles. The number of times this occurs can be controlled by the size of the step of the horn frequency increase or decrease. In the example under discussion, this will happen 120 times each second, one second being the approximate period between flashes. Therefore, the highest value which "Vcount" can attain between flashes is 120. This is also true when the "SKIP" function is activated and the flash period becomes two seconds, i.e., Control Program No. 2 is executed 240 times between flashes, since blocks 498 and 500 allow "Vcount" to be incremented only if either the "SKIP" function is off or both the "SKIP" function is on and the horn frequency is sweeping up.

Returning to block 494, if RTCC has not exceeded "LTvalue", the program jumps to block 508 and "Vcount" will not be incremented. In block 508, the program checks to see if a strobe fault had occurred. If this is the case, the control variable "SoscSD" is turned on to prevent the strobe oscillator from restarting during a strobe fault. At block 512, the program checks to see if the "oscillator shut down" function is on. If not, the oscillator circuit is turned on at block 514. If "SoscSD" is on, the control program proceeds to block 516 without turning on "Sosc". In block 516, the program checks to see if the unit is in "AUTO" mode. If so, the value for "MUTE" is turned off in block 518 to prevent muting. If the system is not in "AUTO" mode, the control program is exited without turning off the "MUTE" value.

Now, turning to FIGS. 4D, 4E, 4F and 4G, which represent the flowchart for the Control Program No. 2, the program checks at block 530 to see if the "FLASH" function has been activated. If not, at block 578, the switch (SCR) Q3 of the alarm unit is turned off via the pin 1 of the micro-controller and the next several program functions relating to determination of the input voltage are passed over.

If the "FLASH" function is on, the program, at blocks 538, 542 and 546, checks to see whether the number of drop outs, represented by the variable "DOnmbr", indicates that a FWR input voltage is being used, and the variable "Vin" is set to the appropriate input voltage type, either FWR or D.C.

The next function carried out by the micro-controller software relates to the feature discussed briefly hereinabove whereby the alarm unit will compensate for a below-nominal input voltage by lowering the flash frequency. More particularly, when the input voltage is determined to be below 20 volts, the flash frequency will be cut in half to approximately 0.5 Hz, or one flash every two seconds. Determination of the input voltage is accomplished using the variable "Vcount" which, as previously discussed, under certain circumstances is incremented in the Control Program No. 1 when the opto-oscillator circuit has not been shut down and the real time clock counter as represented by variable "RTCC" has exceeded "LTvalue".

Before performing this function, however, the program, at block 548, checks to see if "SKflash" is off. If not, then the voltage check is passed over and the program proceeds to block 562. If, on the other hand, the current flash is not being skipped, then at block 550 "Vcount" is compared to a predetermined constant, "Vref".

As discussed above, "Vcount" will never be incremented higher than 120 within the time period between flashes, and, if the input voltage is over 20 volts, "Vcount" should be incremented all the way to 120 during each flash cycle. If the input voltage is below 20 volts, "Vcount" should be zero. In the embodiment under discussion, the value of "Vref" is chosen to be 30 which will smooth the switch between flashrates.

If, at block 550, "Vcount" exceeds "Vref", the input voltage is determined to be at least 20 V and the "SKIP" function is deactivated at block 554. If "Vcount" is less than "Vref", the input voltage is determined to be less than 20 V and the "SKIP" function is turned on at block 558. After the comparison, "Vcount" is reset to zero and the "FLASH" function is turned off at block 562.

At block 564, the program again checks to see if "SKflash" is off. If not, the program checks to see if the voltage of microcontroller pin 10 (Vcap) is "HI" or "LOW."

If Vcap is "HI," the capacitor C4 still has a charge and, in block 570, the program sets "Sfault" to "YES", "SKIP" to off and "Sosc" to off to prevent overcharging of the capacitor C4. This is considered a "strobe fault." Vcount is also set to Vref+1. If Vcap is "LOW," a normal low charge after the flash exists in the capacitor C4 and "Sfault" is set to "NO" in block 568. If, at block 564, "SKflash" is ON, the program continues at block 572.

Next, at block 572, the program determines whether the "SKIP" function is on. If so, "SKflash" is toggled at block 578. If not, "SKflash" is turned off at block 574 and the program continues on at block 580.

At block 580, the program again checks whether the "SKIP" function is on. If not, the program resets "RTCC" and "AFcount" to zero and turns off "SoscSD" at block 586. If "SKIP" is on, then block 582 ensures that block 586 will be executed only if the horn frequency is currently being swept upward.

The software continues at block 588 which determines whether the "SILENCE" function is off and the "CODE3" function is on. If not, the program skips the next function, which is maintenance of the Code 3 horn signal, and goes directly to block 618. If the conditions are met at test 588, the time since the last sync pulse, represented as "SYtimer", is checked at block 592. If it is equal to 0.5 seconds, then the variable "C3count", which keeps track of the sync pulses in each Code 3 signal cycle, is decremented at block 596.

Each sync pulse triggers one-half second of silence followed by a one-half second horn blast, except when "C3count"=1. During that sync cycle, the horn blast is muted.

After decreasing "C3count", the program checks at block 600 to see if "C3count" is zero. If not, block 604, which sets "C3count" to 4, is skipped. Next, block 608 checks to see if "C3count" is greater than 1. If so, the "MUTE" function is turned off at block 612. If not, block 612 is skipped and the program moves to the next task.

At block 618 (see FIG. 4F), the program checks which mode the system is currently in, auto or sync. If it is in sync mode, "SYtimer" is increased at block 622. Block 626 compares "SYtimer" to the predetermined maximum time, "SYlimit", at which the system should be allowed to continue in the sync mode. If "SYtimer" is not less than "SYlimit", then there is a problem with the sync pulses and the mode is switched to auto at block 630. If not, the mode is left at sync and the Control Program No. 2 is exited at block 634.

If the system is in auto mode, that is, the alarm units are operating independently of one another, "FRtimer", a variable which keeps track of the time since the last flash when in the auto mode, is decremented at block 638 and "C3count" is set to its initial value, "C3ini". At block 642, if "FRtimer" is not down to zero, Control Program No. 2 is exited. If "FRtimer" is zero, it is set to its initial value, "FRini", at block 646, and the "FLASH" function is turned on. In block 648, the program checks to see if a strobe fault had occurred. If "Sfault"="YES", the switch Q3 is activated. If a fault condition is not found, the program continues with block 652. Block 652 checks to see if the "SKIP" function is off. If not, block 654 checks to see if "SKflash" is on. If "SKflash" is on, the control program No. 2 is exited. If not, the program flashes the strobe at block 658 by turning on the switch Q3. Returning to block 652, if the "SKIP" function is off, the program jumps to block 658 which flashes the strobe and exits.

While the invention has been described herein by reference to preferred embodiments thereof, it will be understood that such embodiments are susceptible of variation and modification without departing from the inventive concepts disclosed. For example, in the appended claims, the means for performing the different functions may be only a single microprocessor within an alarm unit or the interface control circuit, as described above, or several microprocessors or functional circuits may be employed. All such variations and modifications, therefore, are intended to be included within the spirit and scope of the appended claims.

I claim:

1. An alarm unit comprising:

means for producing a visual alarm signal comprising a flashtube, first means for storing energy supplied from a power source and second means for storing energy to be supplied to said flashtube, the first and second energy-storing means being electrically connected in series;

first switch means connected in series to the first energy-storing means and having a first state in which energy is stored in the first energy-storing means and a second state in which energy is transferred from the first energy-storing means to the second storing means;

inrush-limiting resistance means connected in series with the second energy-storing means;

second switch means having a first state and a second state, the second switch means being operatively coupled to the inrush-limiting resistance means such that, in the first state thereof, current flows through the inrush-limiting resistance means and, in the second state thereof, current does not flow through the inrush-limiting resistance means;

first means for controlling the operation of the visual alarm signal producing means; and second means for controlling the operation of the second switch means so that the second switch means is in the first state for a time period sufficient to minimize inrush to the second energy-storing means.

2. The alarm unit of claim 1 wherein the flashtube and second energy-storing means are connected in parallel and the visual alarm signal producing means further comprises a diode and an afterglow resistor connected in series between the first storing means and the flashtube so that current does not flow through the flashtube after a flash, thereby preventing afterglow in the flashtube.

3. The alarm unit of claim 1 further comprising means for producing an audible alarm signal, the operation of which is controlled by the first controlling means.

4. The alarm unit of claim 1 wherein the first controlling means comprises a microcontroller.

5. The alarm unit of claim 1 wherein the second controlling means comprises a microcontroller.

6. The alarm unit of claim 1 wherein the second controlling means comprises a timer.

7. The alarm unit of claim 1 wherein the first switch means comprises a transistor operatively coupled to the first energy-storing means and an optocoupler.

8. The alarm unit of claim 1 wherein the inrush-limiting resistance means comprises at least one resistor.

9. The alarm unit of claim 1 wherein the inrush-limiting resistance means is connected in parallel to said second switch means.

10. The alarm unit of claim 1 wherein the second switch means comprises a transistor operatively coupled to the second controlling means.

11. The alarm unit of claim 10 wherein the inrush-limiting resistance means comprises a first terminal and a second terminal and wherein the transistor comprises a base terminal, a collector terminal and an emitter terminal, the base terminal operatively coupled to the second controlling means, the collector terminal connected to a node between the second energy-storing means and the first terminal of the inrush-limiting resistance means, and the emitter terminal connected to the second terminal of the inrush-limiting resistance means.

12. The alarm unit of claim 10 further comprising a base resistor connected between the base terminal of the transistor and the second controlling means so that current flowing from the second controlling means to the base terminal is limited.

13. The alarm unit of claim 1 wherein the time period is substantially 100 milliseconds after power is first applied to the alarm unit.

14. The alarm unit of claim 1 wherein the first energy-storing means is an inductor.

15. The alarm unit of claim 1 wherein the second energy-storing means is a capacitor.

* * * * *

UNITED STATES PATENT AND TRADEMARK OFFICE

CERTIFICATE OF CORRECTION

PATENT NO. : 5,673,030

DATED : September 30, 1997

INVENTOR(S) : Joseph Kosich

It is certified that error appears in the above-identified patent and that said Letters Patent is hereby corrected as shown below:

On the title page:

Item 73, "Wheellock" should read --Wheelock--;

Col. 6, line 63 (element R5), "27 KΩ" should read --27Ω--.

Signed and Sealed this

Twenty-sixth Day of May, 1998

*Attest:*

Bruce Lehman

BRUCE LEHMAN

*Attesting Officer*

*Commissioner of Patents and Trademarks*